United States Patent [19]

Löhr

[11] Patent Number: 4,522,236

[45] Date of Patent: Jun. 11, 1985

[54] ELECTRICAL SYSTEM FOR MONITORING WARP YARNS IN WEAVING MACHINES

[75] Inventor: Heinz P. Löhr, Hergatz, Fed. Rep. of Germany

[73] Assignee: Lindauer Dornier Gesellschaft mbH, Lindau, Fed. Rep. of Germany

[21] Appl. No.: 475,495

[22] Filed: Mar. 15, 1983

[30] Foreign Application Priority Data

Mar. 20, 1982 [DE] Fed. Rep. of Germany ..... 3210333

[51] Int. Cl.[3] ..... D03D 51/28

[52] U.S. Cl. ..... 139/353; 28/187; 66/163; 200/61.18

[58] Field of Search ..... 139/353–357, 139/349, 336; 112/278, 273; 66/163; 28/187; 340/677; 200/61.18

[56] References Cited

U.S. PATENT DOCUMENTS

| | | | |
|---|---|---|---|
| 3,246,091 | 4/1966 | Koch | 200/61.18 |
| 3,324,899 | 6/1967 | Stagg, Jr. | 139/353 |
| 3,725,911 | 4/1973 | Cook et al. | 139/353 X |
| 3,940,954 | 3/1976 | Romoli | 139/336 X |
| 4,321,951 | 3/1982 | Hintsch | 139/353 |
| 4,333,411 | 6/1982 | Lerner | 112/278 |

FOREIGN PATENT DOCUMENTS

| | | | |
|---|---|---|---|
| 1448686 | 9/1976 | United Kingdom | 66/163 |

*Primary Examiner*—James Kee Chi

*Attorney, Agent, or Firm*—W. G. Fasse; D. H. Kane, Jr.

[57] ABSTRACT

The invention relates to a system for electrically monitoring warp yarn ruptures, comprising drop wires which in case of rupture of a warp yarn will fall from the warp yarns on an electrical contact rail. The locating time to determine the precise site of warp yarn rupture is thereby shortened substantially. To achieve this aim, the contact rails are severally divided in the longitudinal direction, that is, in the direction of the weft yarns. Light-emitting diodes are mounted at each of such divisions which they bridge. Those LEDs lighting up in case of warp yarn rupture permit rapidly reading off the narrower range within which a warp yarn rupture has taken place.

6 Claims, 2 Drawing Figures

ELECTRICAL SYSTEM FOR MONITORING WARP YARNS IN WEAVING MACHINES

FIELD OF THE INVENTION

The invention relates to a system for electrically monitoring wrap yarns in weaving machines. When weaving fabrics, the warp yarns require monitoring and any rupture in a warp yarn must be immediately located in order to shut down the weaving machine or loom and correct the defect.

DESCRIPTION OF THE PRIOR ART

Devices for the above purpose are known wherein electrically conducting rails are mounted underneath the set of warp yarns and extend transversely to the warp yarns across the entire weaving width. Essentially, the rails consist of two mutually parallel parts insulated from each other. The individual warp yarns support light weight drop wires riding thereon and dropping therefrom in case of rupture in a yarn, whereby they bridge the insulation between the rail parts and thus make an electrical contact. In this manner, an electrical signal is released which may initiate manifold switching processes, for instance a shut down of the weaving machine and an optical display for the benefit of the operator. Due to the plurality of the monitored warp yarns and the correspondingly large number of drop wires, several of such warp monitoring rails, as a rule, are arranged together and mutually parallel, approximately within a single plane below the set of warp yarns.

While these known devices for electrically monitoring warp yarns have been found quite practical, they nevertheless have the substantial drawback that, even though the rupture of a warp yarn is indicated in general only as a result of the signal-induced immediate shutdown, the operator is forced thereupon to laboriously locate the ruptured yarn among the set of yarns. This may require appreciable time, especially when several warp monitoring rails must be checked. Additionally, it requires a correspondingly long time after remedying the yarn rupture until the machine can be made operational again. Such a lengthy production shutdown however represents a substantial economic drawback.

OBJECT OF THE INVENTION

It is therefore the object of the present invention to minimize the shutdown times in devices for electrically monitoring warp yarns in a weaving machine by shortening as much as possible the time required by the operator to locate the ruptured warp yarn.

SUMMARY OF THE INVENTION

By dividing the overall rail length into several segments, the operator is provided with the display not only of the rail associated with a yarn, but also at once with the narrower segment wherein a warp yarn has ruptured. In this manner, the search time is restricted solely to this segment and, accordingly, is reduced to a fraction of the time previously required. Displays to mark the particular rails and rail segments preferably are light emitting diodes.

BRIEF DESCRIPTION OF THE DRAWING

An example embodiment of the invention is described below with reference to the accompanying drawings, in which.

DETAILED DESCRIPTION OF A PREFERRED EXAMPLE EMBODIMENT AND OF THE BEST MODE OF THE INVENTION

Figure 2:
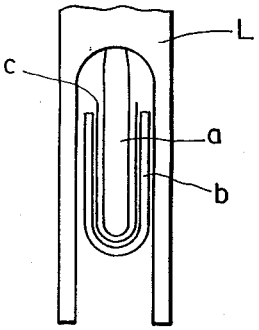
PRIOR ART FIG. 2
FIG. 2 is an end view of a warp monitoring rail.

The construction of a conventional warp monitoring rail will be first discussed with reference to FIG. 2 showing an end view of such a rail, having two parallel partial rails, namely the inside partial rail a which is enclosed in a U-shape by an outer partial rail b. An electrical insulating layer c electrically insulates the two partial rails a and b. A monitoring voltage is applied to the ends of the two partial rails a and b. FIG. 2 also shows part of a warp-monitoring drop wire L. It is now assumed that the associated warp thread has ruptured and that the drop wire has dropped. In that position, as shown in FIG. 2, the drop wire L is resting on the partial rail a and encloses with both its legs, both sides of the warp monitoring rail, whereby these legs of the drop wire L at some point contact the outer partial rail b thereby bridging the insulation c. As a result, a current from a voltage source flows through the partial rail a, the drop wire L and the other partial rail b for triggering a signal, in a known manner not further disclosed herein.

Figure 1:
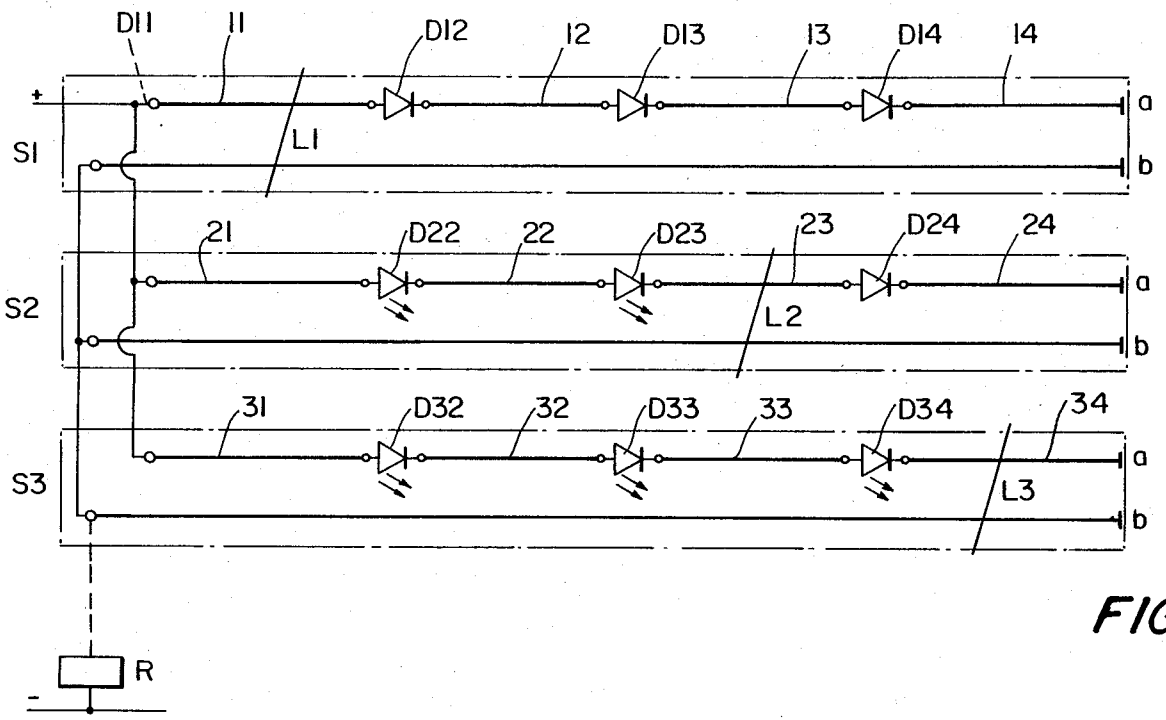
FIG. 1 is a schematic circuit for the electrical monitoring of warp yarns.

The invention will now be discussed with reference to FIG. 1. The dash-dot frames denote several warp monitoring rails S1, S2 and S3. The two partial rails a and b for each of these rails are shown in a simplified manner. The rails S1 to S3 pass transversely beneath the warp yarns not shown. The mutually corresponding parital rails a and b of each warp monitoring rail S1 to S3 are connected electrically in parallel, for instance the positive terminal of a voltage source is connected to the partial rail a and the negative terminal through a relay R to the partial rail b.

In the example embodiment shown, the partial rail a of each rail S1 through S3 is divided three-fold, so that four mutually separated segments are formed from the entire length of the rail. These segments are denoted by 11, 12, 13, 14 in rail S1, by 21, 22, 23, 24 in rail S2 and, correspondingly, by 31, 32, 33, 34 in rail S3. The sequential segments, for instance segments 11 and 12 in rail S1 are insulated from one another. The insulation is indicated in the drawing by the terminals at the ends of the two segments. The insulated divisions are bridged by light emitting diodes or LEDs. For instance the division between the segments 11 and 12 is bridged by LED D12. LEDs D13 and D14 are indicated at the further division in the rail S1. Other LEDs D22, D23, D24 and D32, D33, D34 are correspondingly provided in the rails S2 and S3 respectively.

In operation, when there are no warp yarn ruptured, all the segments of the partial rails a remain insulated with respect to the associated partial rails b in all rails S1 through S3, and the relay R is not energized. In the case of a warp rupture, a drop wire, for instance drop wire L2, associated with this yarn will drop and remain caught on the rail S2. It makes contact, for example, with the segment 23. As a result, an electrical current from the voltage source flows through the rail S2 into the segments 21, 22 and 23, the drop wire L2, the partial rail b, and the relay R to the other source terminal, whereby the relay R is actuated and initiates in known manner the required steps, for instance machine shutdown and an overall display of warp yarn rupture. To this extent, the procedure corresponds to the state of the art. However, simultaneously, current passes in rail S2 through the LEDs D22 and D23 inserted between the segments 21 and 22, and 22 and 23, respectively; these diodes thus light up, as indicated, by two small parallel arrows in the drawing. Current does not flow through the LED D24 on the right of the drop wire L2, accordingly LED D24 is not luminescent. The two LEDs D22 and D23 show that the ruptured warp yarn is associated with the rail S2 and must be located in the segment 23 between the last lighted LED D23 and the ensuing dark LED D24.

As regards the example of the rail S3, it is assumed that a drop wire L3 dropped in the segment 34. As a result, all the LEDs D32, D33 and D34 in the rail S3 become luminescent. Therefore, the ruptured yarn must be located in the last segment 34 to the right of the LED D34. In the case of the rail S1, it is assumed that a drop wire L1 fell in the first segment 11. In this case also the relay R responds at once and initiates the required switching processes. The LEDs D12, D13 and D14 in the rail S1 remain dark; therefore the defect must be in the preceding segment 11. A further LED can be electrically connected at the beginning D11 of the segment 11, where by the first segment would be directly indicated by the lit condition of such further LED.

The number of divisions and LEDs for each rail can be so selected as a function of the widths of the weaving machines as to form easily inspected segments and to keep the search time for these segments low. As both the particular rail and the particular segment holding a dropped drop wire are displayed, the operator can locate the ruptured yarn substantially more rapidly than previously. The system also operates in problem-free manner if several warp yarn ruptures occur simultaneously, provided the warp yarns involved belong to different rails. Each yarn rupture and the associated segment is separately displayed. If several warp yarns should rupture in different segments of the same rail, then the first display will be for the yarn rupture nearest to the input terminals of the power supply, and once remedied, automatically for the yarn rupture to the right thereof.

The LED system can be implemented without difficulties in such a manner that only small gaps exist between the drop wires at the divisions and that the drop wires fall unhampered in case of yarn rupture.

It will be appreciated by those skilled in the art that modifications may be made within the scope of the present invention without departing from the spirit thereof, and the invention includes all such modifications.

What I claim is:

1. In a system for electrically monitoring warp yarns in a weaving machine, wherein electrically conducting monitoring rail means include at least one continuous first rail member and at least one sectioned second rail member, insulating means electrically insulating said first and second rail members from each other, said second sectioned rail member including a plurality of rail sections also electrically insulated from each other but arranged in a row extending substantially in parallel to said continuous first rail member, and drop wire means operatively arranged for electrically connecting said continuous first rail member to any one of said rail sections of said second rail member in response to any warp yarn rupture, the improvement comprising an electrical monitoring circuit including individual indicator means electrically connected in series with adjacent rail sections (11, 12, . . . ) for forming an electrical series circuit of rail sections alternating with said individual indicator means, a source of electrical power, conductor means electrically connecting said first continuous rail member to one terminal of said electrical power source, and further conductor means electrically connecting said series circuit to another terminal of said electrical power source, whereby at least one of said individual indicator means is energized by said electrical power source in said electrical monitoring circuit when said drop wire means drop to thereby pinpoint a location where a warp yarn rupture occurred.

2. The system of claim 1, comprising a plurality of first rail members electrically connected in parallel to each other, a plurality of said electrical series circuits also electrically connected in parallel with each other, whereby one first rail member and a respective one of said electrical series circuits are arranged to form a pair, and wherein said drop wire means comprise a plurality of drop wire members arranged for cooperation with the respective pair.

3. The system of claim 1, wherein said individual indicator means comprise at least one relay electrically connected in series in said electrical monitoring circuit in such a position that at least said relay will be energized when said drop wire means drop for providing an indication of a warp yarn rupture.

4. The system of claim 1, wherein said individual indicator means comprise a number of indicator elements corresponding at least to the number of rail sections whereby said series circuit of rail sections and individual indicator means comprises one indicator element between each two adjacent rail sections and at least one indicator element in series with an end of said series circuit.

5. The system of claim 1, wherein said individual indicator means comprise a plurality of light emitting diodes connected in said series circuit.

6. The system of claim 5, wherein the number of lit light emitting diodes in said series circuit provides an indication of a location where a warp yarn rupture has occurred.

* * * * *